US005263292A

United States Patent [19]

Holland et al.

[11] Patent Number: 5,263,292

[45] Date of Patent: Nov. 23, 1993

[54] BUILDING PANEL SYSTEM

[75] Inventors: Thomas G. Holland; David L. Smalley, both of Hickory, N.C.

[73] Assignee: American Wall Products, Hickory, N.C.

[21] Appl. No.: 638,389

[22] Filed: Jan. 7, 1991

[51] Int. Cl.[5] ..... E04B 1/38

[52] U.S. Cl. ..... 52/235; 52/508; 52/509; 52/511; 52/775

[58] Field of Search ..... 52/508, 509, 510, 511, 52/822, 775, 235

[56] References Cited

U.S. PATENT DOCUMENTS

| | | | |
|---|---|---|---|
| 2,066,205 | 12/1936 | Keating | 52/508 |
| 2,927,355 | 3/1960 | Rasmussen | 52/509 |
| 3,671,061 | 6/1972 | Dawdy | 52/511 |
| 3,672,107 | 6/1972 | Santry et al. | 52/511 |
| 4,251,964 | 2/1981 | Francis | 52/235 |
| 4,685,263 | 8/1987 | Ting | 52/235 |

FOREIGN PATENT DOCUMENTS

| | | | |
|---|---|---|---|
| 1149500 | 12/1957 | France | 52/509 |

*Primary Examiner*—Michael Safavi
*Attorney, Agent, or Firm*—Olive & Olive

[57] ABSTRACT

A system for the preparation and installation of building exterior panels is presented which is both economical and practical. In the described embodiments, edge mounting members having anchor teeth are assembled on all four sides of a laminated aluminum panel having routed out edges. Anchor sockets having anchor teeth indents adapted to mate lockingly with the anchor teeth of the edge mounting members are affixed to the building frame in a mating relation to the edge mounting members and in a location to accept the panel. The panel is snapped into engagement with the anchor sockets locking the anchor teeth into the anchor teeth indents obtaining a permanent attachment. Individual panels may be replaced in case of damage.

9 Claims, 7 Drawing Sheets

BUILDING PANEL SYSTEM

BACKGROUND OF THE INVENTION

1. Field of the Invention

This invention relates to the field of building construction, and more particularly to the constructing of buildings having modular exterior panels mounted thereon.

2. Description of the Prior Art

In certain architectural styles, particularly as applied in large commercial and institutional buildings, exterior panels of sheet-like form are utilized. It has been found to be aesthetically attractive and economically functional to cover a large section of a building, for instance ten feet by twenty feet, in a single sheet of material. When such materials can be produced in a factory in a large sheet form and applied as one piece, it can save considerable amount of labor and time in the construction schedule.

A particularly useful material in this context has been sheet aluminum. It is relatively lightweight, can be cut or machined readily and can be anodized in its natural appearance or in a color to enhance its appearance and weather resistance. To further improve the desirable characteristics of this material, a hollow panel with internal stiffening members can decrease the weight and cost still further without serious loss in strength and stiffness properties.

A construction of stiffened laminated aluminum panels has found considerable acceptance in the building trades, especially where the stiffening members are transverse to the main plates, such as a clustered honeycomb pattern. Such a panel is made by H. H. Robertson Company, and is utilized in the present invention.

One prior art system which utilizes a prefabricated panel mounted on the frame of a building is disclosed in U.S. Pat. No. 4,435,934 to Kim. The system taught involves the use of self-threading fasteners to anchor the panel to the building frame at top and bottom. A system of interlocking clips are used to join the sides and seal against weather. While this system allows the use of a panel-type construction, it relies on screws as the main holding force which both limits the strength and requires a considerable amount of field labor to install.

Another panel assembly system is taught in U.S. Pat. No. 4,633,634 to Nemmer et al., in which the panel is prepared with grooves and the building has mating channel frame members. The panel is assembled to the channel frame by sliding the panel into the grooves from the top to the bottom. This method is fairly successful in a single-story building, but will present practical problems in the construction of a multi-story building. Also, in case of severe winds, the panels are prone to pull out of their anchoring.

A variation of the technology taught by Nemmer et al. has been used in the building trade and applies to multi-story buildings. It is a panel system utilizing tall channels into which the panel fits, placing a second panel directly on top of a first panel to obtain the required height. This system presents the significant difficulty of replacing individual panels in case of damage, because it is necessary to remove all upper panels to replace a lower one. This can become a costly process.

Other methods of construction employing exterior panels have been used, but the difficulties of labor cost to install, cost and time to replace a single panel and the potential for damage or loss due to wind remain. In particular, when a multi-story building is constructed with exterior panel siding, the upper floors are particularly exposed to higher velocity winds. In the prior art methods of attaching the panels, the edge grip strength has not been sufficient to withstand the high wind forces since they rely on systems such as screws or channels. The force of the wind on a large panel can exert tremendous pressure on the anchoring means.

Therefore, it is an object of the invention to provide a building panel construction system which is economical and easy to install in the field.

It is a further object of the invention to present a building panel construction system which will withstand high velocity wind forces without loss of attachment or damage.

It is a further object of the invention to present a building panel construction system which will permit the replacement of individual panels in case of damage without the need to remove other panels which are adjacent thereto.

Additional objects of this invention will become apparent to those skilled in the building industry as the description proceeds.

SUMMARY OF THE INVENTION

This invention provides a novel and useful building panel system which satisfies the objects set forth and is particularly practical. The system utilizes an aluminum panel having a honeycomb core between exterior plates and which has inherent stiffness and is light in weight. In the embodiments described by way of example, the raw panel is cut to a size to accommodate the opening in the building frame within a close tolerance. Then the edge of the core portion of the panel is routed out, leaving the two exterior plates on all sides. Edge mounting members are assembled and riveted to the prepared plate on all four sides, completing the panel fabrication. A sealant is added for weather resistance.

Anchor sockets, formed to mate in locking engagement with the edge mounting members of the fabricated panel, are attached to the building frame in a location to match the panel dimensions. The fabricated panel is then brought into contact with the sockets which are on the building. Final engagement is accomplished by use of a mallet on a cushioned stiff plate which results in snapping the lock mechanism into place.

Successful high velocity wind tests have been performed, proving the weather stability of the system. It is believed that due to the unique structure of the interlock between the edge mounting member of the panel and the anchor socket on the building frame, a wind force tending to pull the panel away from the building side will actually press the lock into tighter engagement.

Individual panel replacement is easily accomplished since the panels are effectively each an independent system, including mounting means. To remove one panel, it is necessary to destroy it, but not to harm any adjacent panels in the process. Inserting a new panel is as easy as inserting the original.

DETAILED DESCRIPTION OF THE PREFERRED EMBODIMENTS

This invention provides an improved exterior panel wall construction and method for constructing an improved exterior panel wall of a building to overcome safety and economic drawbacks of the previously existing construction techniques. The system of the invention allows the prefabrication of a relatively light weight and relatively rigid exterior panel having a special perpheral edge mounting member on each side thereof such that the panel may be quickly secured to the building frame after the building frame has been fitted with mating anchor sockets. The resultant building may be thus completed in a short time and be resistant to weather infiltration and damage under the most severe of conditions.

Models of the building system of the invention have been tested in a wind tunnel to withstand a wind force of 140 miles per hour which is a force significantly greater than hurricane force. The panels of the invention can be made in almost any size that can be reasonably produced and handled with the larger sizes requiring further stiffening reinforcement to prevent bowing under stress.

The panels are individually mounted on the building frame and therefore each panel can be removed and replaced without disturbing other panels.

Figure 1:
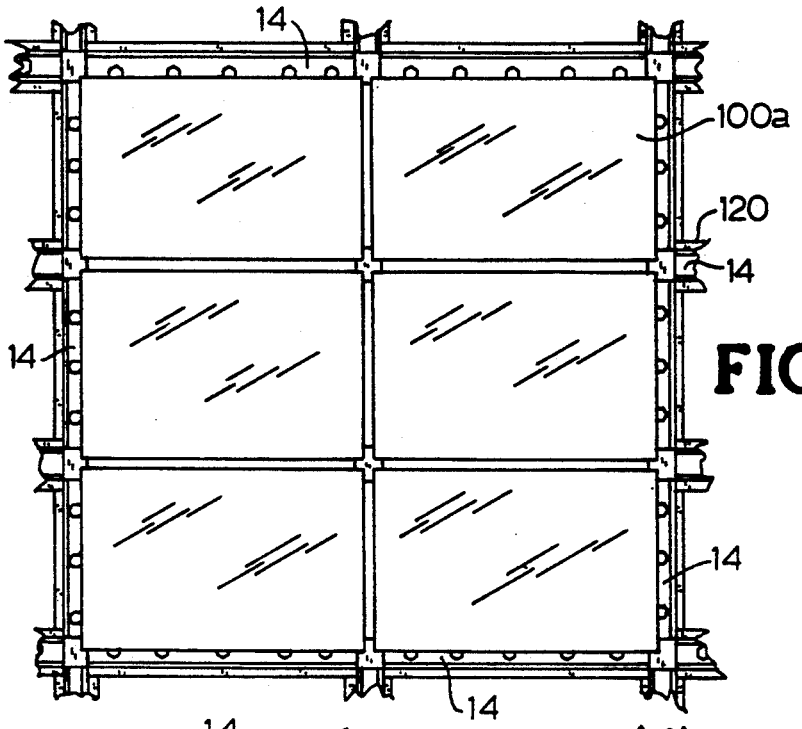
FIG. 1 is a front elevation view of a portion of a building structure having prefabricated panels constructed and fitted to the building according to the invention and showing several of such prefabricated panels mounted on the building frame and several sections of protruding building frame with anchor sockets constructed and fitted on the building frame according to the invention.
Figure 1A:
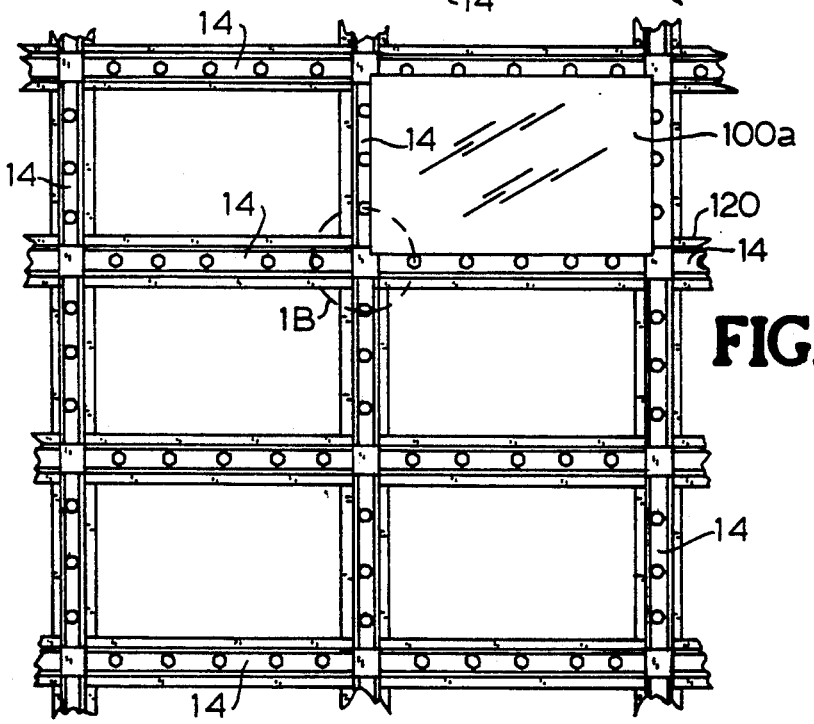
FIG. 1A is a front elevation view of a portion of a building frame with anchor sockets mounted thereon, including a representative mounted panel.
Figure 1B:
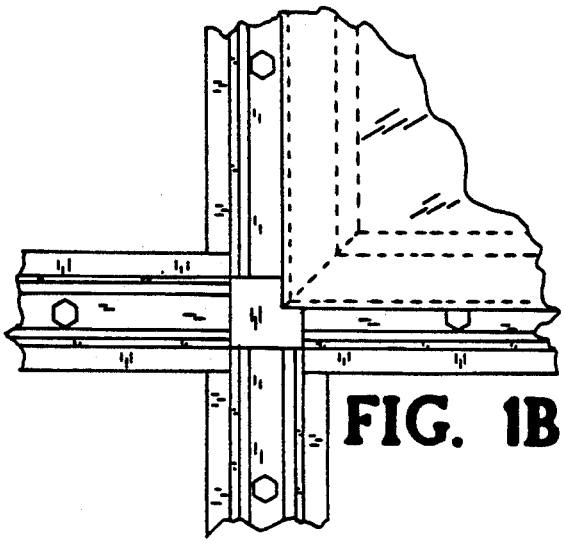
FIG. 1B is an enlarged front elevation view of the portion of the building frame of FIG. 1A within the circle labelled 1B, showing greater detail of the intersection of two building frame members with the anchor sockets of the invention mounted thereon and a portion of a panel.

In FIG. 1 there is illustrated a portion of an assembled building frame 120 onto which is mounted a number of prefabricated panels 100*a* according to the invention. Several sections of the building frame 120 are shown protruding without the panels 100*a* in place as next described. FIG. 1A shows another portion of the building frame 120 having anchor sockets 14 mounted to frame members 120 and one panel 100*a* installed at one corner. FIG. 1B details in an enlarged view the intersection of building frame member 120 indicated by the circle labelled 1B shown in FIG. 1A. As is common in the construction of buildings, the building frame 120 delineates a series of rectangular openings and is made of a structurally strong material, typically steel. While it is common for the rectangular openings to be completely empty, it is possible to have parallel or angulated structural components within the general frame of one or more of the rectangular openings without interfering with the system of the invention, so long as such components do not protrude external to the main frame of the structure.

Figure 2:
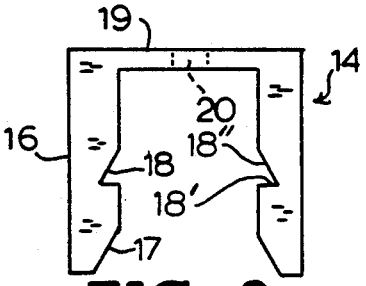
FIG. 2 is an end view of one embodiment of an elongate anchor socket of the invention which has two retaining arms.
Figure 2A:
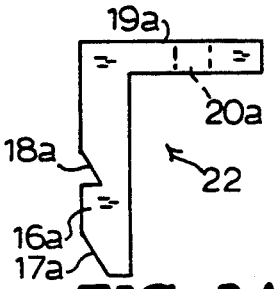
FIG. 2A is an end view of another embodiment of an elongate anchor socket having only one retaining arm.
Figure 2P:
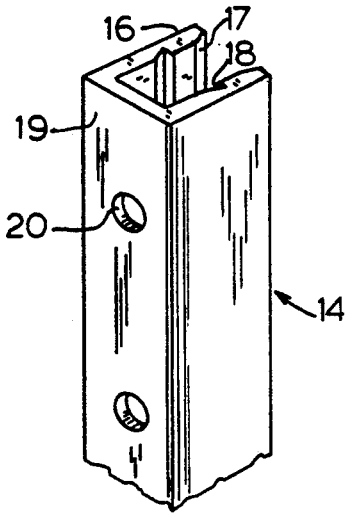
FIG. 2P is a partial perspective rear view of the anchor socket of FIG. 2 showing detail of the bolt holes drilled in the base portion thereof.

The process of fitting and mounting the elongate anchor sockets such as anchor sockets 14 (FIG. 2) to the building frame members 120 involves a variety of component embodiments adapted to the exact location and purpose of the anchor. Each of the anchor sockets of the invention are best made of metal such as aluminum by the process of extrusion, resulting in long continuous lengths. As shown in FIGS. 2 through 2P, several embodiments of the anchor socket are portrayed as will be employed in a variety of location situations in the construction of a building. In FIGS. 2, 2P anchor sockets 14 are the basic embodiment for mounting completed panels to the building frame structure 120 between two adjacent and parallel panels of the invention. Each anchor socket 14 has two retaining arms 16 which are substantially perpendicular to the base plate 19, the outer surfaces of anchor socket 14 each being basically planar. Each retaining arm 16 has an inwardly facing angle portion 17 adapted to guide the entry of an edge mounting member as disclosed below. Each retaining arm 16 additionally has an inwardly facing anchor tooth indent 18 adapted to secure the inserted edge mounting member, the indent 18 having a surface 18' (FIG. 2) parallel to base 19 at a position distal from base 19 so as to enable a complementarily shaped anchor tooth to enter but not escape. The angular surface 18'' of anchor tooth indent 18 is generally parallel to angle portion 17. In the base 19 of each elongated anchor socket 14 are a series of bolt holes 20 (FIG. 2P) adapted to permit fastening members 44 (FIG. 8) to securely assemble the anchor socket 14 to the building frame member 120.

FIG. 2P illustrates in perspective view a pattern of mounting bolt holes 20 situated along the length of base 19 on an elongate anchor socket 14. Further embodiments of the anchor socket as shown in end view in FIGS. 2A–2D will be similarly elongate in structure and have holes 20 similarly situated.

Figure 7C:
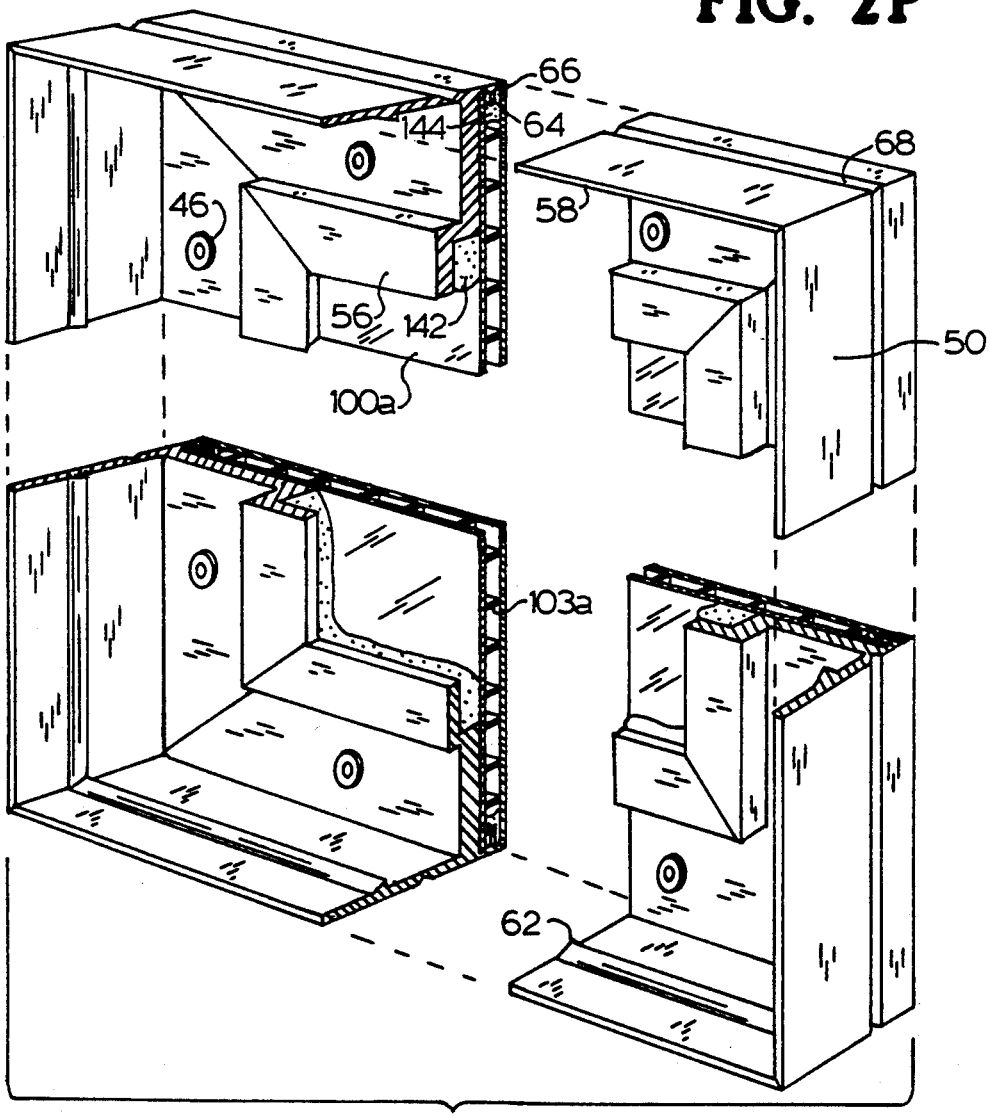
FIG. 7C is a perspective view of the completed panel of FIG. 7B of the invention, showing the four corners with mitered edge mounting members assembled thereto.
Figure 7:
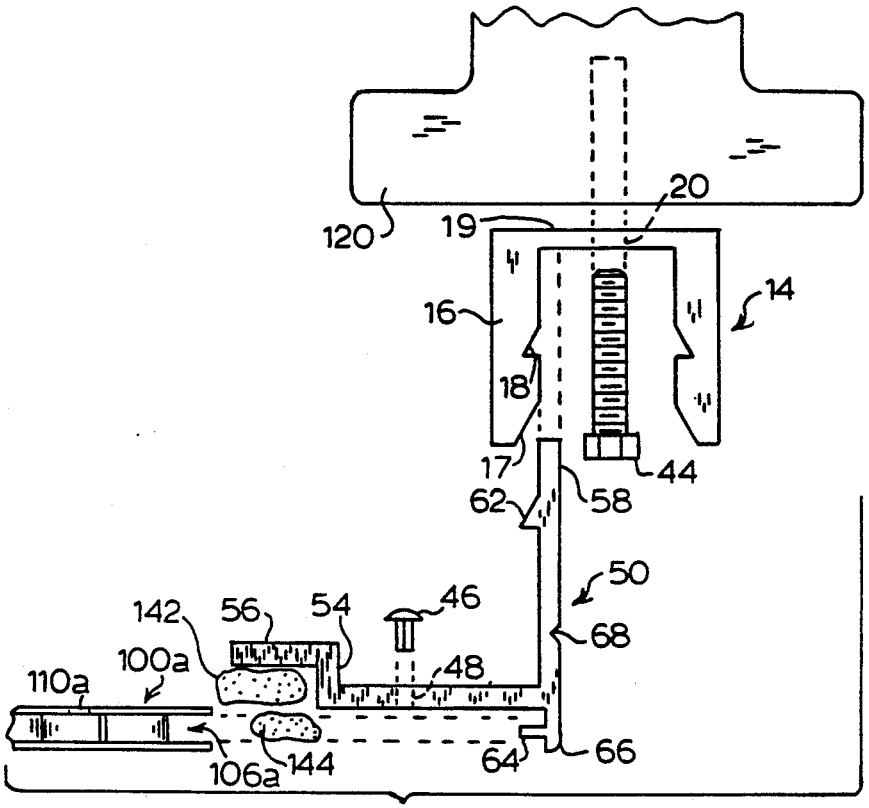
FIG. 7 is an exploded end view of the components of the invention which have been individually illustrated in FIGS. 2, 3 and 4A as they are about to be assembled.

Referring now to the exploded assembly drawing of FIG. 7, anchor socket 14 is shown positioned to be mounted to building frame structure 120 by means of a series of bolts 44 which assemble through bolt holes 20 in the base 19. It is to be understood that the anchor sockets 14 are best made by being extruded from a material such as aluminum and in long lengths having a constant cross sectional shape and then cut to appropriate lengths according to the size of the rectangular openings in the building frame 120. The holes 20 for bolts 44 are placed at locations along the length of the elongate anchor socket 14 at appropriate distances which are determined by the architect or structural engineer. It is not necessary to miter the ends of the cut lengths of anchor socket 14, though this may be done in certain applications.

Figure 4:
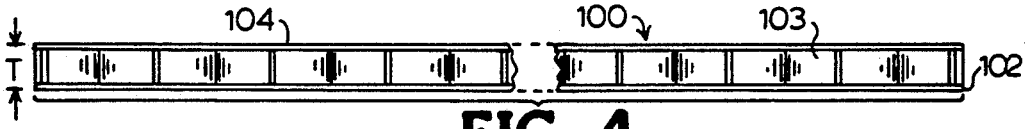
FIG. 4 is an end view of the panel used in the invention as received and prior to processing.

FIG. 4 illustrates an end view of the unprocessed panel 100 as received. Panel 100 has an exterior face 102 in parallel spaced relationship with an interior face 104, both faces made of aluminum. The outer surface of exterior face 102 may be finished in a material to enhance the appearance or improve the weather resistant properties of panel 100. Between outer face 102 and inner face 104 is a core 103 such that the thickness of the completed panel 100 is T. The core 103 in the preferred panel is made of aluminum in the form of a honeycomb matrix of adjoining hexagonal cells oriented with the axes of the hexagons perpendicular to the exterior and interior faces 102, 104 and permanently joined thereto. A panel that performs satisfactorily in the invention is sold commercially as a Formacore TM panel by H. H. Robertson Company.

Figure 4A:
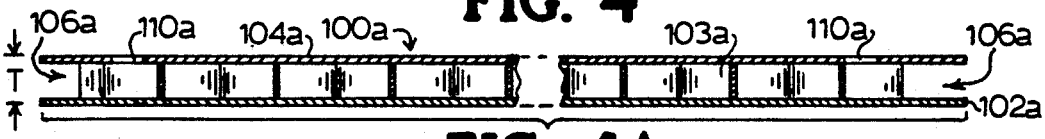
FIG. 4A is a sectional view of the panel of FIG. 4 after processing has begun, showing the routed out edge sections, taken along a line passing through the drilled rivet holes.

The processing of the panel 100 prior to assembly onto the building first involves cutting the panel 100 to size and shape according to the size and shape of the openings in the building frame 120 of FIG. 1. As will be well appreciated, the size and angular conformity of cut panel 100 must be quite precise to properly fit to the premounted anchor sockets 14. Similarly, each anchor socket 14 must be assembled to building frame members 120 to close tolerance to achieve the proper degree of designed-for fit between components. For purposes of description, a representative panel after being processed is referred to as panel **100*a* in FIG. 4A. Subsequent to the cutting of the panel, a groove 106*a* is routed along all edges of the panel 100*a* by removing the core 103*a* to a specified depth without damaging the inwardly facing surfaces of faces 102*a* and 104*a* as shown in FIG. 4A. The depth of core 103*a* to be removed by routing is at least sufficient to accommodate the insertion of a tab on an edge mounting member as described below, but not enough to cause a loss in rigidity of faces 102*a*, 104*a*. A series of holes 110*a* are drilled through the interior face 104*a* in locations to match holes in the edge mounting member described below for later assembly by riveting. Holes 110*a* are not continued through exterior face 102*a* to preserve the appearance and weather resistant properties of panel 100*a***.

Figure 3:
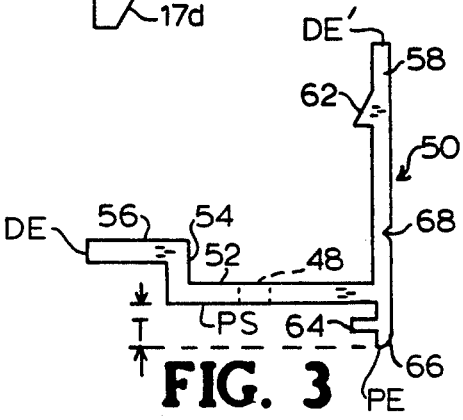
FIG. 3 is an end view of an embodiment of an elongate edge mounting member of the invention.
Figure 3A:
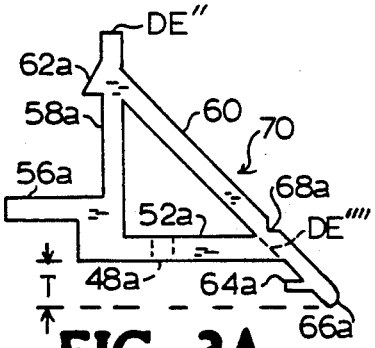
FIG. 3A is an end view of another embodiment of an elongate edge mounting member adapted for an exterior corner of a building.
Figure 3B:
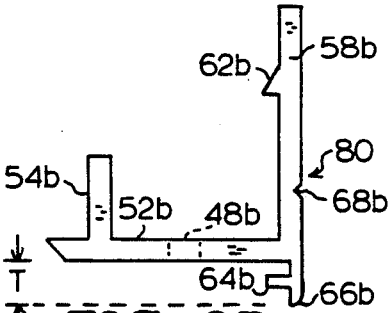
FIG. 3B is an end view of another embodiment of an edge mounting member for use with a panel whose edge segment is bent at a perpendicular to the main plane of the panel.
Figure 3P:
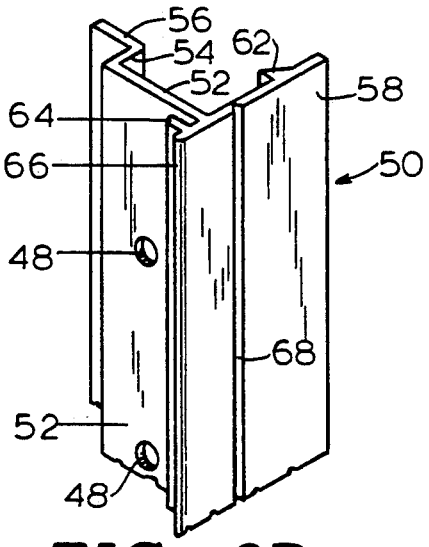
FIG. 3P is a partial perspective rear view of the edge mounting member of FIG. 3 showing detail of the bolt holes drilled in the base portion thereof.

The mating components for anchor sockets 14 and panel **100*a* in the basic design of the invention according to a first embodiment are elongate edge mounting members 50 of FIG. 3, a portion of one of which is also known in perspective in FIG. 3P. The various styles of edge mounting members as drawn in FIGS. 3–3B are best made from a material such as aluminum by the process of extrusion, resulting in long continuous lengths having a constant cross sectional shape. Each edge mounting member 50 has a parallel leg 52 and a perpendicular leg 58 connected at a proximal end of parallel leg 52. At the distal end DE of parallel leg 52 is offset 54 extending perpendicularly therefrom, which connects to parallel flat 56 extending a further distal distance from perpendicular leg 58. Upon later assembly, parallel leg 52 will lie against the interior face 104*a* of panel 100*a* with offset 54, flat 56 and panel 100*a* forming a recess for the application of a sealing compound. In the central section of parallel leg 52, a series of holes 48** are drilled to be used for rivets upon assembly.

Perpendicular leg 58 extends on both sides of parallel leg 52 and is adapted to insert into an anchor socket 14 of FIG. 2 such that anchor tooth 62 will snap into anchor tooth indent 18. The longer portion of leg 58 of the edge mounting member 50 as well as the retaining arm of anchor socket 14 both exhibit a degree of resilence which facilitates this snap-fit connection. Anchor tooth 62 is spaced appropriately from the distal end DE' of perpendicular leg 58 and facing in the same direction as parallel leg 52 has a complementary shape to indent 18. At a further distance from the distal end DE' of parallel leg 52 and on the opposite surface of perpendicular leg 58 is gasket indent 68, adapted to receive and retain a weather sealing gasket to be discussed below. Gasket indent 68 is formed in the preferred embodiment as an elongate groove running the length of elongate edge member 50 with intersecting planar sides at substantially similar angles to the surface of leg 58 and having a depth sufficient to accommodate the sealing gasket to be discussed below.

Perpendicular leg 58 extends a distance proximally beyond parallel leg 52 to end at rounded corner 66 such that the distance from the proximal surface PS of leg 52 to the extreme proximal end PE of corner 66 is T, being equal to the thickness T of panel 100*a*. Thus, upon assembly, interior face 104*a* of panel 100*a* is pressed against parallel leg 52 and the edge of exterior face 102*a* meets the extremity of corner 66. Corner 66 is rounded to blend smoothly from the plane of perpendicular leg 58 to the plane of the exterior face 102*a* of panel 100*a*. Insert tab 64 protrudes parallel to parallel leg 52 at a position approximately midway between leg 52 and corner 66 and inserts into the routed out edge 106*a* of panel 100*a* as shown in the exploded view of FIG. 7 and in the assembly view of FIG. 7B. To prepare each edge mounting member 50 for assembly it is necessary to cut an appropriate length from the long length as produced. Cutting is done with a miter so that the ends of flat 56 of FIG. 3 and the ends of perpendicular leg 58 meet on adjacent legs, therefore deterring the infiltration of weather elements or dirt.

Figure 7A:
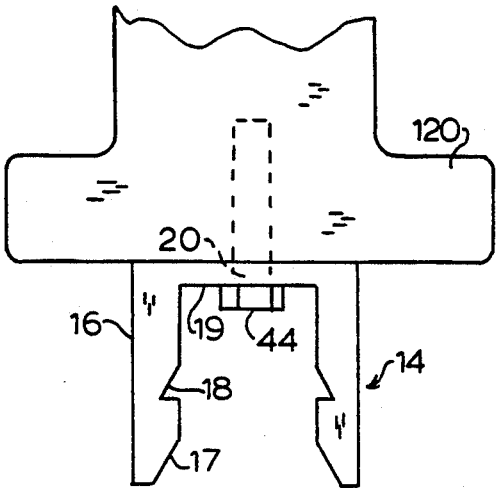
FIG. 7A is an end view of the FIG. 2 anchor socket of the invention after assembly to the building frame has been accomplished.
Figure 7B:
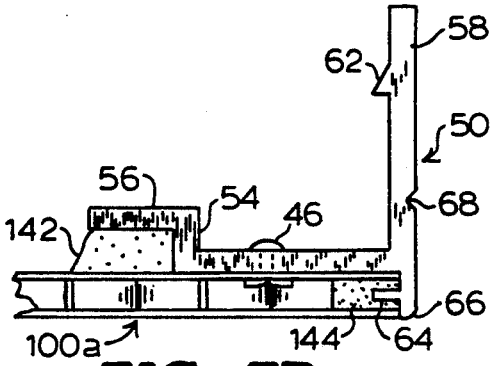
FIG. 7B is an end view of the FIG. 3 edge mounting member and the panel of the invention after assembly has been accomplished.

As seen in FIG. 7B, sealing and adhesive material 144 is next inserted into the routed-out edge 106*a* of panel 100*a*, and edge mounting member 50 is brought into mating contact, embedding insert tab 64 in the sealing material 144 as shown in FIG. 7B. A silicone sealing compound is satisfactory for this function. A blind rivet 46, such as a Pop-Rivet® fastener, is inserted through hole 48 (FIG. 3) and hole 110*a* (FIG. 4A) and swaged into securing contact to hold edge mounting member 50 to panel 100*a*. Next, a silicone sealing compound 142 is pressed into the sealing groove formed between the flat 56 and panel 100*a* to act as a further infiltration deterrent and component adhesive. A similar assembly is done on the other three edges of panel 100*a*, optionally adding silicone compound to seal the mating ends of the mitered portions as well.

A perspective view of the representative assembled panel 100*a* and edge mounting members 50 at the panel corners appears in FIG. 7C. In this view, the corner portions of panel 100*a* are seen assembled to the mating corner portions of edge mounting members 50. Each corner is joined with a miter cut to totally enclose the underlying structure and resist infiltration of water or dirt. Rivets 46 are shown in a number of representative locations to securely attach the edge members 50 to panel 100*a*. Corner 66 extends to the extremity of panel 100*a* so that panel 100*a* is not seen at the edges. Sealing compound 142 is shown in the notch between panel 100*a* and flat 56 and sealing compound 144 is shown embedding the insert tab 64.

FIG. 7A illustrates the assembly of an anchor socket 14 to building frame member 120 by means of bolts 44 through holes 20 and into a matching threaded hole in frame member 120. Other means of assembly, such as rivets may be employed where appropriate. The positioning of the anchor sockets 14 with respect to one another is exactly matched to the size of the panels 100*a* so as to ensure a proper fit and secure attachment thereto.

After having securely affixed an edge mounting member 50 to the inner surface and each edge of panel 100*a* the panel assembly is ready to be mounted to the respective anchor sockets 14 which have been previously mounted around a corresponding opening in building frame 120. This is done by placing the perpendicular legs 58 of the edge mounting members 50 assembled to panel 100*a* against the anchor sockets 14 with all four sides in contact and exerting sufficient force at the edges, either simultaneously or in sequential increments, so that the anchor tooth 62 on each perpendicular leg 58 engages the matching anchor tooth indent 18 in each anchor socket 14. As each edge mounting member 50 is brought into close proximity with its respective anchor socket 14, the distal end of the respective perpendicular leg 58 is assisted into proper location by the inwardly facing angle portion 17. Further insertion of each edge mounting member 50 brings the angled surface of its anchor tooth 62 into contact with the corresponding angle portion 17. A degree of force will be required to cause legs 58 and anchor socket retaining arms 16 to spread outwardly as each anchor tooth 62 is cammed by the corresponding mating angle portion 17 of an anchor socket 14. Continued pressure will move the perpendicular legs 58, members 50 and panel 100*a* into final position as each anchor tooth 62 snaps into locking engagement with an anchor tooth socket 18. In order to assemble panel 100*a* with least distortion and effort it is best to apply the inserting force across each corner of panel 100*a* by means of a cushioned stiff member hit with a heavy rubber mallet.

Once all four sides of panel 100*a* have been installed so that each edge mounting member 50 is in full engagement with its mating anchor socket 14 and all anchor teeth 62 are set into the anchor tooth indents 18 the panel 100*a* will be firmly in place and may be removed only by irreparably damaging components of the assembly. However, it is possible to damage and remove one panel from a completed building and replace it with a new panel in the system of the invention without removing or damaging other panels which is one of the principal objects of the invention as previously stated.

Figure 8:
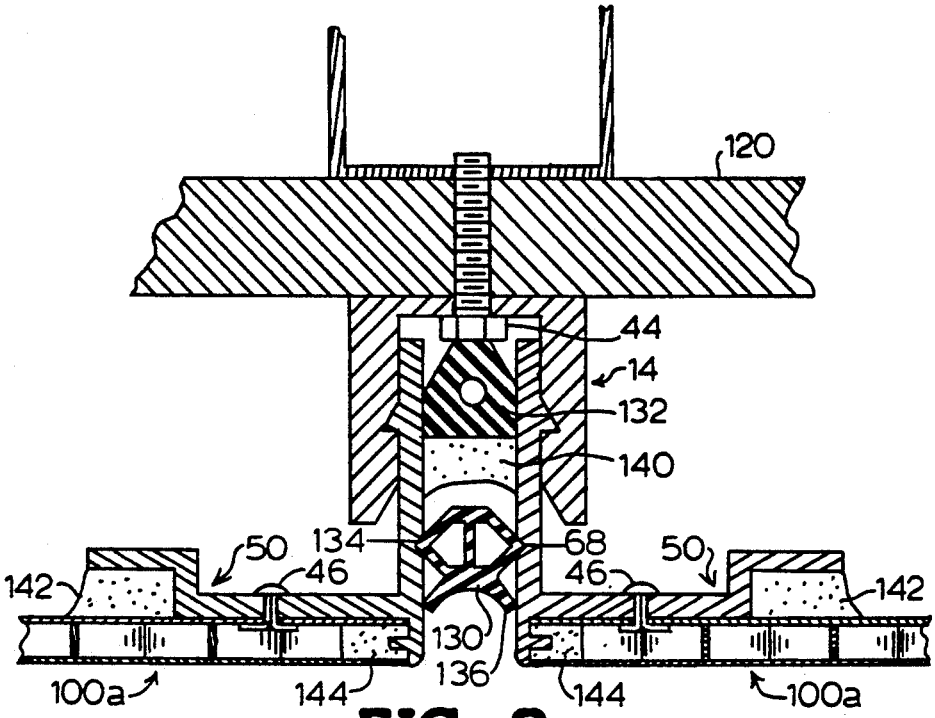
FIG. 8 is a sectioned end view of one embodiment of the invention showing the completed assembly as used in a mid-wall section where two planar panels join.

As was earlier seen in discussion of FIG. 2, each anchor socket 14 has two retaining arms 16 with opposed inwardly facing anchor tooth indents 18. An additional panel 100*a*, assembled as per the description above with four edge mounting members 50 will be mounted adjacent the first panel so that the left edge mounting member 50 of a first panel 100*a* and the right edge mounting member 50 of a second panel 100*a* will occupy opposite segments of anchor socket 14 as best depicted in FIG. 8.

Figure 5:
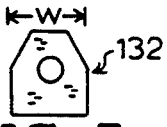
FIG. 5 is an end view of the pressure gasket of the invention.

As added security for permanent attachment of each panel 100*a* assembly to the building frame 120, a pressure gasket 132 (FIG. 8) is forced into the interstitial space between the opposed faces of the edge mounting members 50 so as to apply outward pressure on each member 50 and prevent escape of each respective anchor tooth 62 from its respective anchor tooth indent 18. Pressure gasket 132, as shown in detail in FIG. 5, is preferably made of a silicone material for environmental resistance and chemical compatibility with any additional silicone sealant applied thereupon. Width W (FIG. 5) of pressure gasket 132 is of a dimension and the selected silicone material is of such hardness so that when the gasket 132 is inserted into the interstitial space it applies substantial pressure to hold both edge mounting members 50 in locked engagement with the anchor socket 14 as in FIG. 8. Pressure gasket 132 is extruded in long lengths and may be inserted into the space essentially continuously along the seams between adjacent panels in one direction and cut to the size of the panel in the other direction.

Figure 6:
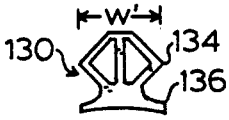
FIG. 6 is an end view of the sealing gasket of the invention.

A silicone sealing compound 140 is also applied into the space between adjoining panels 100*a* after pressure gasket 132 has been installed to act as a weather sealant and adhesive to assure the permanent retention of pressure gasket 132. Lastly, sealing gasket 130 is inserted in the same referred to space as in FIG. 8. Sealing gasket 130 is also made of an extruded silicone compound for similar reasons to those mentioned above. The width W' (FIG. 6) of sealing gasket 130 is selected to be greater than the width between adjacent edge mounting members 50 as in FIG. 8 and is adapted to have outwardly facing points 134 snap into the gasket indents 68 as seen in FIG. 8. In assembled position, flaps 136 press against the facing walls of the edge mounting members 50 to prevent infiltration of water or dirt.

The description given above describes the principles and operational procedures involved in the first and basic embodiment of the invention. The following will describe further embodiments as adapted to a variety of construction conditions encountered.

Figure 9:
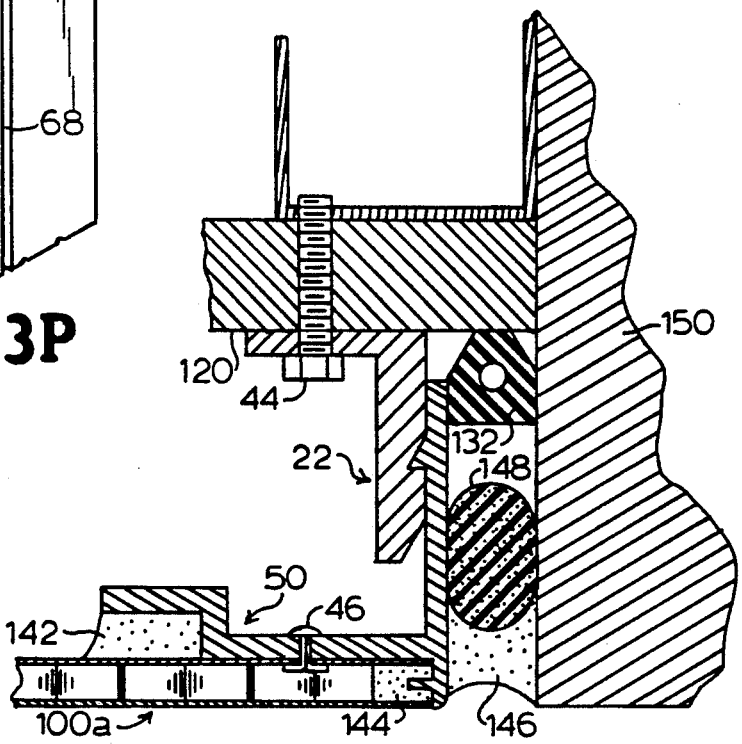
FIG. 9 is a sectioned end view of another embodiment of the invention showing the completed assembly as used in a section joining the panel of the invention to another structure.

FIG. 9 illustrates a typical interface between a panel 100*a* assembly and another surface such as a brick wall 150. Since only one panel 100*a* is used, anchor socket 22, detailed in FIG. 2A is employed as the mounting anchor component. As seen in FIG. 2A anchor socket 22 has features similiar to those of anchor socket 14 in FIG. 2 but has only one retaining arm 16*a*. The single retaining arm 16*a* has angle face 17*a* and anchor tooth indent 18*a* on the side opposite that of the base 19*a* which will be attached to the building frame 120. An identical edge mounting member 50 of FIG. 3 is used on all four sides of panel 100*a*, and the assembled panel 100*a* is forced onto the anchor sockets 22. A pressure gasket 132 as described above is inserted into the space between the edge mounting members 50 and the brick wall or other surface 150, the space being designed to cause lateral pressure to be applied by gasket 132. After pressure gasket 132, a backer rod 148, produced as a cylindrical extrusion of silicone compatible foam material, is pressed into position causing its cross-section to become somewhat ellipsoidal as seen in FIG. 9. Backer rod 148 acts as a surface against which to install the next component comprising a silicone sealing compound 146. The silicone sealing compound 146 is installed to seal against the environment and to adhere to the edge mounting member 50 and wall 150.

Figure 10:
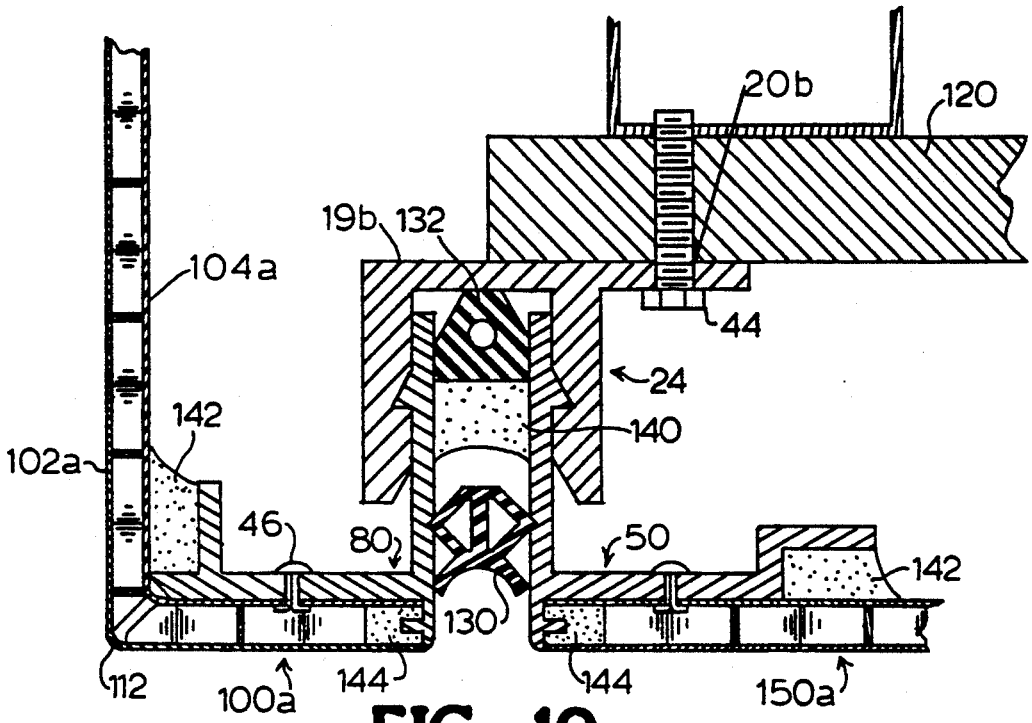
FIG. 10 is a sectioned end view of another embodiment of the invention showing the completed assembly as used at an outside corner with the edge segment of one panel bent at a perpendicular to the main plane of the panel.

An additional embodiment of the invention may be employed according to architect's plans as is shown in FIG. 10, typically a drip at a panel soffit. Panel 100*a* is further prepared in this style by being bent into a right angle. To accomplish this angle with mimimum distortion, the interior face 104*a* (FIG. 4A) is cut in a "V" configuration along the length to be bent, leaving only the exterior face 102*a* intact. The "V" notched portion of the panel is then warmed and bent into a 90° position so that the exterior face 102*a* forms a generally smooth outer corner 112 as seen in FIG. 10. Edge mounting members 80, as detailed in FIG. 3B, are used on the bent panel 100*a*. As the extension of parallel leg 52*b* terminates in a flat plane continuous with the main portion of the leg 52*b*, offset 54*b* protrudes perpendicular to leg 52*b* and in the same direction as perpendicular leg 58*b*. The overall length of parallel leg 52*b* and the length inside the short bent portion of panel 100*a* (FIG. 10) are essentially equal. Silicone sealing compound 142 may then be inserted in the space between offset 54*b* and the long portion of bent panel 100*a* and the components locked together by rivet 46 as seen in FIG. 10.

Figure 2B:
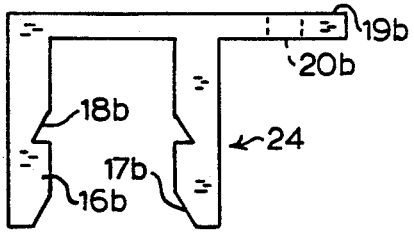
FIG. 2B is an end view of another embodiment of an elongate anchor socket having two retaining arms and a laterally extended base.
Figure 2D:
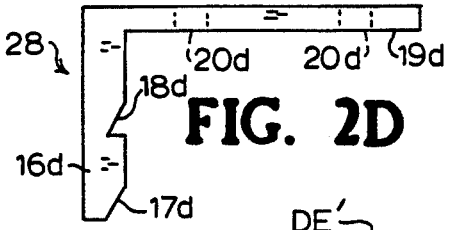
FIG. 2D is an end view of another embodiment of an elongate anchor socket having one retaining arm with an elongated base.

The anchor socket style used in the FIG. 10 embodiment being described is socket 24 of FIG. 2B. As will be noted in FIG. 10, the building frame member 120 extends only partially behind anchor socket 24, thus requiring the base 19*b* (FIG. 2B) and the mounting hole 20*b* to be extended beyond the two retaining arms 16*b*. The internal structure and function of anchor socket 24 are similar to those discussed with respect to socket 14 of FIG. 2.

As will be understood by those skilled in the art, the other edges of panel 100*a* will be routed as in the basic embodiment illustrated and discussed relative to FIG. 8. On assembly of the bent panel 100*a* to the anchor sockets 24 in FIG. 10, the edge mounting members 80 must be inserted into the sockets 24 first, and then the other three edges pressed into engagement. After mounting an adjacent assembled planar panel 150*a*, pressure gasket 132, silicone compound 140 and sealing gasket 130 are installed as discussed above and as further seen in FIG. 10.

Figure 11:
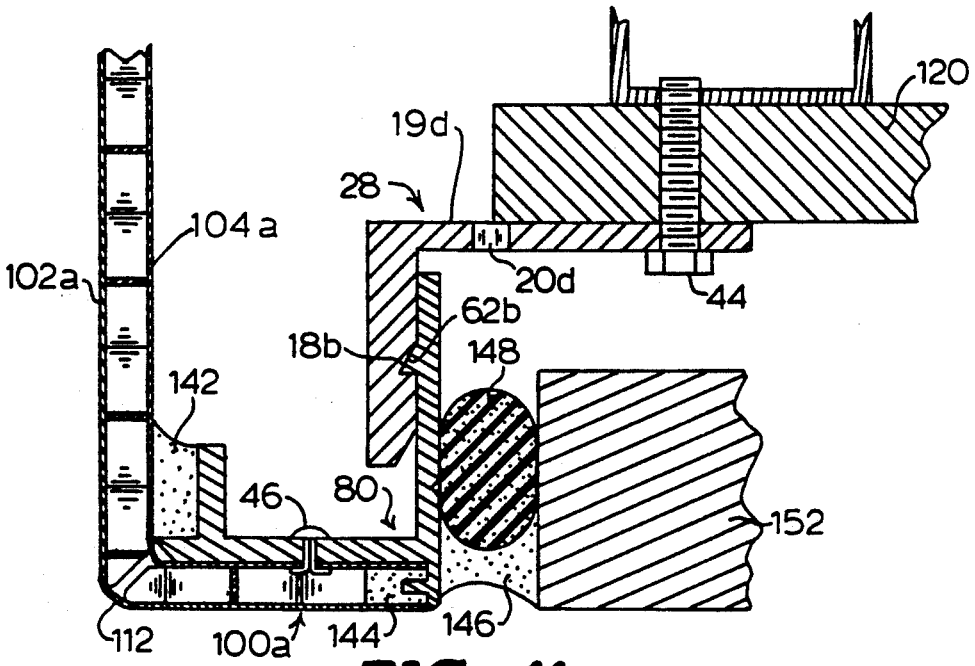
FIG. 11 is a sectioned end view of another embodiment of the invention showing the completed assembly as used at an outside corner with the edge segment of the panel bent at a perpendicular to the main plane of the panel and joining the panel of the invention to another structure.

FIG. 11 portrays a panel 100*a*, bent and assembled to an edge mounting member 80 as indicated above, in use against an adjacent building part such as a two inch panel soffit 152. In a combination of the design concepts of the embodiments in FIGS. 9 and 10, elongated anchor sockets 28 are used. Socket 28 of FIG. 2D has one retaining arm 16*d* with angle face 17*d* and anchor tooth indent 18*d* facing toward the side on which extended base 19*d* is situated. Here again, backer rod 144 and silicone sealing compound 146 are used to complete the joint. There is no pressure gasket in this case since there is no opposed socket surface against which to create the pressure. However, there is virtually no need for that retaining pressure since any forces tending to remove the panel 100*a* would be only significant on the main exterior surface 102*a* and would tend to hold the anchor tooth 62*b* tightly into anchor socket 18*b*.

Figure 4B:
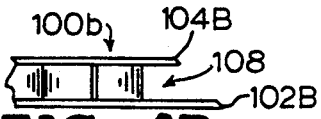
FIG. 4B is a partial end view of another embodiment of the panel of FIG. 4 after processing intended to enable the panel to mount to the exterior corner anchor socket of FIG. 3A.
Figure 12:
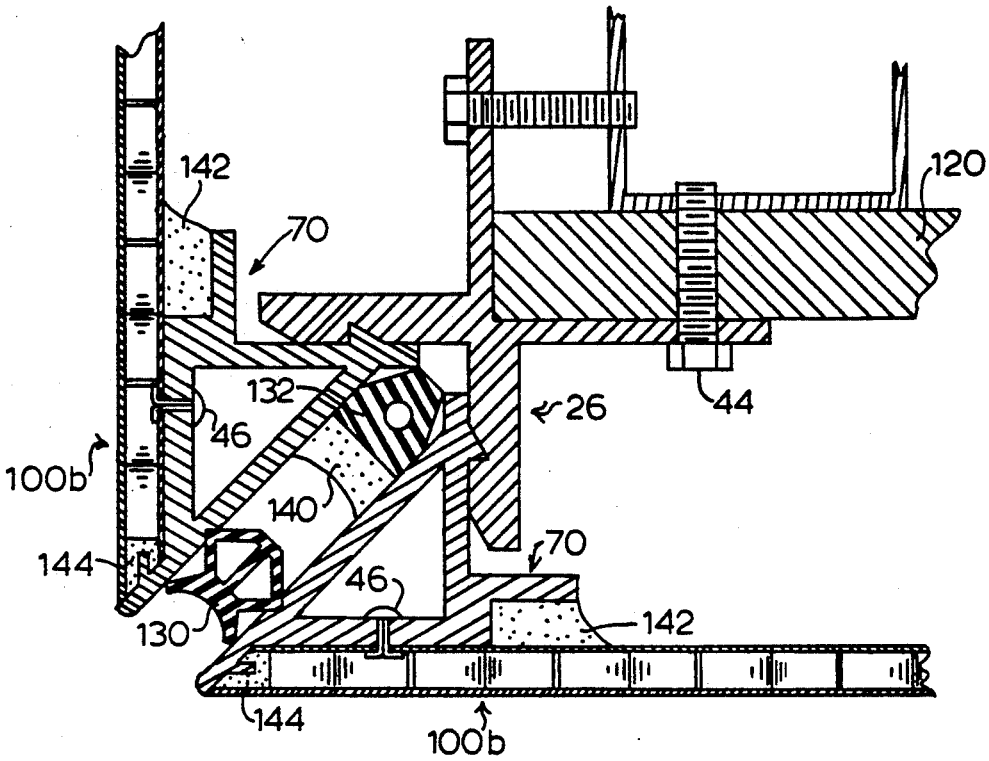
FIG. 12 is a sectioned end view of another embodiment of the invention showing the completed assembly as used at an outside corner with the panels retained in planar perpendicular relationship.

A further embodiment of the invention as applied to an outside corner of the building is shown in FIG. 12. In this style, panel 100*b* is prepared per FIG. 4B on both sides of the building corner. Panel 100*b* is retained planar and not bent to an angle. Panel 100*b* is routed at all edges similar to the operation on panels for the middle of a wall. An added step is employed which is depicted as edge 108 in FIG. 4B. In order to mate at the corner with a different model of edge mounting member 70, panel 100*b* is chamfered as shown so the exterior face 102*b* is longer than the interior face 104*b*.

Figure 2C:
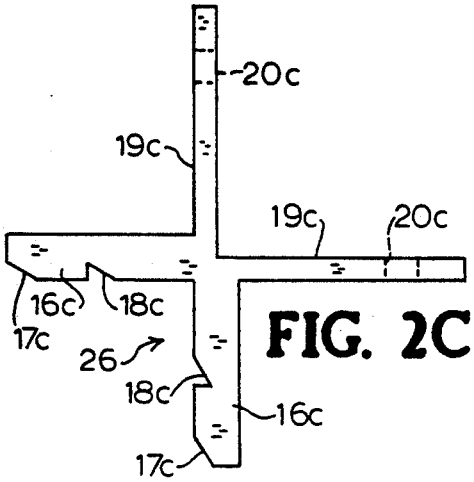
FIG. 2C is an end view of another embodiment of an elongate anchor socket having two retaining arms and two bases perpendicular to each other.

The structure of edge mounting member 70 is illustrated in FIG. 3A, being adapted to use in outside corner treatments such as that in FIG. 12. Edge member 70 has parallel leg 52*a* which is parallel to and spaced away from insert tab 64*a* and the distance from leg 52*a* to the end of rounded corner 66*a*, measured perpendicular to leg 52*a*, is equal to T, the thickness of panel 100*a*. Perpendicular leg 58*a* is joined to leg 52*a* at a point similar to the position of offset 54 (FIG. 3) and continues for a length substantially equal to the length of perpendicular leg 58 shown in FIG. 3. Perpendicular leg 58*a* has anchor tooth 62*a* near its distal end DE" and a portion extending beyond tooth 62*a* to lie against the retaining arm 16*c* of anchor socket 26 of FIG. 2C as discussed below. As edge mounting member 70 is intended for use in outside corners of right angles, cross plate 60 is set at a 45° angle to each leg 52*a*, 58*a* for optimum strength. Cross plate 60 extends from a position behind the anchor tooth 62*a* past the distal end DE'''' of parallel leg 52*a* to terminate in corner 66*a*, formed with a rounded contour, similar to the corners of previously described mounting edge members. The gasket indent 68*a* formed similarly to indent 68 of FIG. 2, appears on the surface of edge member 70 approximately adjacent the intersection of parallel leg 52*a* on the opposite surface. To enable a rivet to be installed to hold edge member 70 to panel 100*a*, an access hole, not shown, may be drilled in cross plate 60*a*.

In this corner embodiment of FIG. 12, anchor sockets 26, as shown in FIG. 2C, are employed. Each socket 26 has two bases 19*c* arranged at a right angle. The extension of one of the bases 19*c* becomes one retaining arm 16*c* and the other becomes the other arm 16*c*, the final cross section resembling an "X". Each base 19*c* has a hole 20*c* for a fastening means to the frame 120 of the building. Each arm 16*c* has an anchor tooth indent 18*c* and an angle portion 17*c* facing inward.

After edge mounting members 70 have been assembled to panel 100*a* in the manner discussed above in regard to other styles, and the anchor sockets 26 have been assembled to building frame member 120, the panel assembly 100*a* can mount to the anchors 26. Simultaneous or sequential pressure techniques as previously described may be utilized. After the panel assemblies have been attached on both sides of the corner, the pressure gasket 132, silicone sealant 140 and sealing gasket 130 are installed as before, acting between cross plates 60 as seen in FIG. 12.

Figure 13:
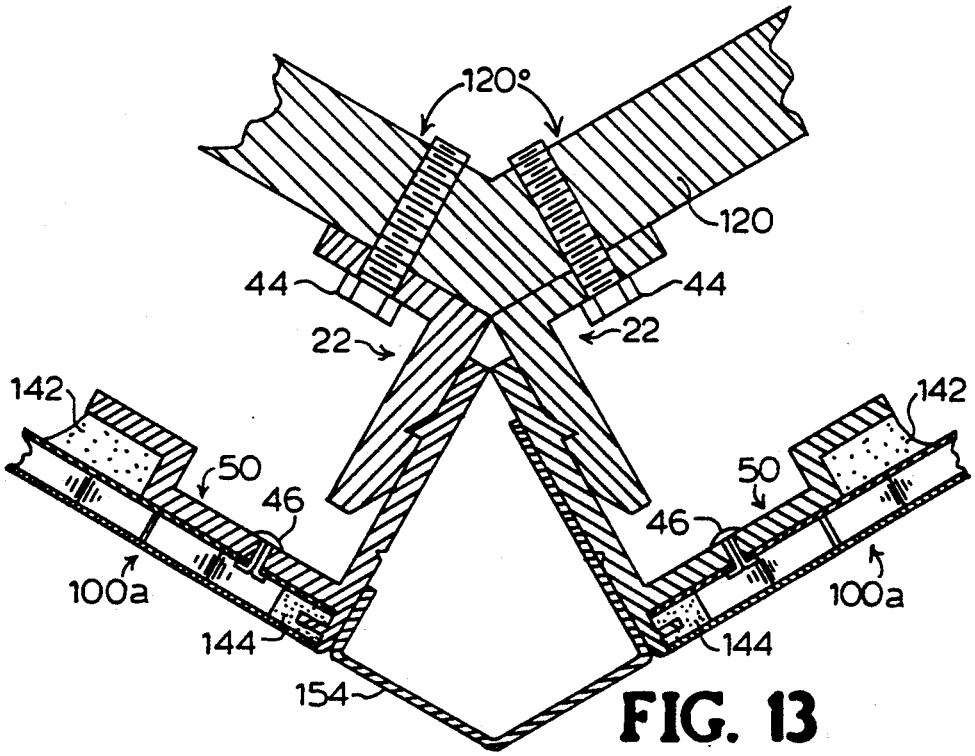
FIG. 13 is a sectioned end view of another embodiment of the invention showing the completed assembly as used at a non-square outside corner utilizing an angularly matching closure strip.

A still further embodiment of the invention applicable to an outside corner which meets at an angle other than 90° is next described although this last described embodiment may also function in a 90° angle corner. According to the illustration of FIG. 13 edge mounting members 50 of FIG. 3 are assembled to panel 100*a* as previously described in relation to FIGS. 8 and 9. The anchor sockets 22 as seen previously in FIG. 2A are fixed to building frame members 120, which are at an arbitrary angle to one another. Panel assemblies on each side of the corner are pressed onto the anchor sockets 22 as earlier disclosed and as seen in FIG. 13. Finally, a length of a deformable sheet material such as aluminum is bent into a contour 154 to fit the angle of the opening and the outer surface and fitted into position with a silicone adhesive and sealer. The exact configuration of contour 154 may vary in a number of respects within the principles of this embodiment.

In all embodiments, it is to be noted that the anchor sockets and edge mounting members are precisely located and precisely spaced. Thus, such precise spacing in conjunction with the inherent resilence of the mated retaining arms of the anchor sockets and the perpendicular legs of the edge mounting members insure extremely tight fits of the panels once installed.

Whereas a number of examples of specific embodiments have been disclosed herein, it is to be understood by those skilled in the art that further optional designs may be utilized within the principles of the invention. For example, the embodiments discussed have related only to building side panels of a rectangular shape, but the technology could similarly apply to panels of triangular or a hexagonal shape.

We claim:

1. A building panel system, comprising:

(a) a plurality of planar panels each having a plurality of linear edges;

(b) a plurality of elongate edge mounting members each being adapted to securely mount to an edge of said panel, and each having an anchor tooth adapted to engage an anchor tooth indent in an anchor socket;

(c) a plurality of elongate anchor sockets each adapted to mount to a building frame member in a position corresponding to an edge of said panel and each having an anchor tooth indent adapted to receive a said anchor tooth;

(d) an insert tab integral with each said edge mounting member adapted to insert into a routed portion of a said panel linear edge; and (e) each said panel comprising a lamination of two exterior face plates and an interior core, said core being of a honeycomb configuration.

2. A building panel system, comprising:

(a) a plurality of planar panels each having an exterior face, a plurality of linear edges, an interior face and a core, each said panel being precision cut to fit a building frame opening dimension and having said core removed from between said faces in a portion adjacent all edges thereof;

(b) a plurality of elongate edge mounting members, the number of said members being equal to the number of said edges of said panel, each said edge mounting member comprising;

(i) a parallel leg adapted to assemble adjacent and parallel said panel with a proximal edge of said parallel leg lying along one edge of said panel and there joining a perpendicular leg;

(ii) said perpendicular leg joined at said proximal edge of said parallel leg and having an outer and an inner surface, said outer surface having a rounded corner at its proximal end and a gasket groove medially disposed thereon, said inner surface having an insert tab joined midway between said proximal end and said parallel leg, and an anchor tooth toward its distal end, said anchor tooth being adapted to lockingly engage an anchor tooth indent in an elongate anchor socket; and (iii) additional edge mounting members for each edge of said panel, said edge mounting members being assembleable to said panel edges such that said insert tab enters the portion where the core of said panel is removed;

(c) a plurality of elongate anchor sockets each being adapted to receive a said edge mounting member, each said anchor socket having a said anchor tooth indent adapted to mate in locking engagement with a said anchor tooth of a said edge mounting member and being further adapted to be fixedly attached to a building frame member;

(d) a pressure gasket adapted to mount between said outer surface of said perpendicular leg of said edge mounting member and another structure and apply a pressure against said perpendicular leg to retain locking engagement between a said anchor tooth and a said anchor tooth indent; and (e) a sealing gasket adapted to mount between said outer surface of said perpendicular leg and another structure to prevent the infiltration of water.

3. The building panel system of claim 2, in which said panel an all aluminum panel having a honeycomb core.

4. The building panel system of claim 3 in which said edge mounting member is assembled to said panel by means of rivets.

5. The building panel system as claimed in claim 2 in which said edge mounting member is mounted to said panel by means of rivets.

6. A building panel construction method, comprising:

(a) cutting a planar panel to a size and shape to match an opening in a building frame member;

(b) peripherally routing a portion of the core from between an outer and an inner face and adjacent the edges of said panel;

(c) cutting a length of edge mounting member for each edge of said panel, said edge mounting member having an insert tab and a leg and being adapted to securely mount to each edge of said panel;

(d) assembling said edge mounting member to said panel such that said insert tab of said edge mounting member enters said routed portion of said edges;

(e) riveting said leg of said edge mounting member to said panel so as to lie adjacent said panel;

(f) cutting a length of an anchor socket having a base portion to match the length of each edge of said panel;

(g) forming a series of holes through said base portion of said anchor socket;

(h) attaching said anchor sockets to a building frame member at locations mating each edge of said panel by attachment means passing through said holes;

(i) forcing said assembled panel and edge mounting members into locking engagement with said anchor sockets;

(j) pressing a pressure gasket into any space between a said edge mounting member and another structure; and (k) pressing a sealing gasket into any space between a said edge mounting member and said other structure.

7. The building panel construction method of claim 6, further comprising mitering the ends of the cut lengths of said edge mounting members.

8. The building panel construction method of claim 7 further comprising applying a sealing compound between the edge mounting members and the panel.

9. The building panel construction method of claim 8 further comprising applying a sealing compound in any spaces between the edge mounting members and another structure and between the pressure gasket and the sealing gasket.

* * * * *

UNITED STATES PATENT AND TRADEMARK OFFICE

CERTIFICATE OF CORRECTION

PATENT NO. : 5,263,292

DATED : November 23, 1993

INVENTOR(S) : Thomas G. Holland, David L. Smalley

It is certified that error appears in the above-identified patent and that said Letters Patent is hereby corrected as shown below:

Column 12, line 68, after "panel" insert --is--.

Signed and Sealed this

Twenty-second Day of February, 1994

Bruce Lehman

*Attest:*

BRUCE LEHMAN

*Attesting Officer*

*Commissioner of Patents and Trademarks*